US006672715B2

(12) United States Patent
Isono et al.

(10) Patent No.: US 6,672,715 B2
(45) Date of Patent: Jan. 6, 2004

(54) INKJET HEAD PREVENTING ERRONEOUS INK EJECTION FROM UNINTENDED ADJACENT NOZZLES

(75) Inventors: Jun Isono, Nagoya (JP); Akira Iriguchi, Ichinomiya (JP); Atsushi Hirota, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 10/166,078

(22) Filed: Jun. 11, 2002

(65) Prior Publication Data

US 2002/0196315 A1 Dec. 26, 2002

(30) Foreign Application Priority Data

Jun. 26, 2001 (JP) ..... 2001-193544
Oct. 12, 2001 (JP) ..... 2001-315846

(51) Int. Cl.[7] ..... B41J 2/045
(52) U.S. Cl. ..... 347/71; 347/72
(58) Field of Search ..... 347/68–72, 9; 310/328, 366, 324

(56) References Cited

U.S. PATENT DOCUMENTS 5,402,159 A * 3/1995 Takahashi et al. ..... 347/72
RE36,667 E * 4/2000 Michaelis et al. ..... 347/69

FOREIGN PATENT DOCUMENTS

JP A 11-334064 12/1999
JP A 2001-162796 6/2001

* cited by examiner

*Primary Examiner*—Stephen D. Meier
*Assistant Examiner*—An H. Do
(74) *Attorney, Agent, or Firm*—Oliff & Berridge, PLC

(57) ABSTRACT

An actuator 120 is formed from nine piezoelectric sheets stacked in this order to give a laminated configuration. A common electrode 25 is formed on the upper surface of each piezoelectric sheet 122, 121*b*, 121*d*, 121*f*, 121*g*. A plurality of drive electrodes 24 are formed the upper surface of each piezoelectric sheet 121*a*, 121*c*, 121*e*, 123. The common electrodes 25, a cavity plate 14, and a cover plate 44 are all maintained at the same potential (0V). The lowermost piezoelectric sheet 122 formed with the common electrode 25 is located between the cavity plate 14 and the lowermost drive electrodes 24 on the piezoelectric sheet 121*a*. In this configuration, an ejection voltage applied to the drive electrodes 24 is reliably prevented from being applied to ink in a pressure chamber and/or the cavity plate 14, whereby reliable ink ejection is possible.

9 Claims, 16 Drawing Sheets

INKJET HEAD PREVENTING ERRONEOUS INK EJECTION FROM UNINTENDED ADJACENT NOZZLES

BACKGROUND OF THE INVENTION

1. Field of the Invention

The present invention relates to a configuration of a piezoelectric type inkjet printer head.

2. Related Art

Japanese Patent-Application Publication No. HEI-11-334064 discloses an example of conventional on-demand type piezoelectric inkjet printer head, which includes a head case and a head member fixed to the head case by an adhesive. The head member includes a substrate, energy generating members, and diaphragms. The substrate is formed with a plurality of nozzles, a plurality of pressure chambers corresponding to the nozzles, and a manifold for supplying ink to the pressure chambers. The energy generating members, such as piezoelectric elements, are one-to-one correspondence with the pressure chambers and attached on a surface of the substrate with the diaphragms interposed therebetween.

The head case is formed of electrically conductive resin and detachably supports ink cartridges. A conductive coating material is applied over the side surfaces of the head casing and the head member to form a conductive layer thereon. The conductive layer is electrically connected to a carriage shaft via an earth plate.

In this configuration, metal components are not charged by static electricity which may be generated when a recording sheet contacts the head member, thereby preventing breakage of the head member due to the static electricity. Also a metal cover for covering over a nozzle surface of the head member is dispensed with. This shortens the distance between the nozzles and the recording sheet, resulting in higher printing quality.

However, providing the above head member requires a number of process steps. A common-electrode film is first formed on the diaphragm, and piezoelectric films are formed thereon at positions corresponding to the pressure chambers by patterning techniques. Then, a drive electrode is formed on each piezoelectric film. Moreover, there is only a single layer of piezoelectric film that deforms the diaphragm, providing only insufficient deforming amount of the diaphragm, so that effective ink ejection cannot be performed.

In order to overcome this problem, the present inventor has proposed in Japanese Patent-Application Publication No. 2000-258007 an inkjet printer head that includes a cavity unit and a piezoelectric actuator. The actuator has a laminated structure of piezoelectric ceramic sheets, common electrodes, and drive electrodes laminated such that each piezoelectric ceramic sheet is sandwiched between a common electrode and a plurality of drive electrodes. The piezoelectric ceramic sheet has a thin thickness of 20 $\mu$m to 30 $\mu$m. The cavity unit is formed of metal with pressure chambers. The bottom surface of the lowermost piezoelectric ceramic sheet is fixed by an adhesive layer to the cavity unit such that the drive electrodes formed on the upper surface of the piezoelectric ceramic sheets are in vertical alignment with the pressure chambers formed in the cavity plate.

SUMMARY OF THE INVENTION

However, in this configuration, an ejection voltage applied to the drive electrode on the lowermost piezoelectric sheet is adversely applied to the cavity unit also via the lowermost piezoelectric sheet, and also to soluble ink, i.e., conductive ink, contained in the pressure chambers. As a result, when an ejection voltage is applied to a drive electrode so as to eject ink from a corresponding pressure chamber, electric current conducts through the piezoelectric ceramic sheets, the cavity unit, and the ink to different drive electrode corresponding to an adjacent pressure chamber, thereby ejecting ink from the unintended adjacent pressure chamber.

Moreover, leakage of the ejection voltage applied to the drive electrode on the lowermost piezoelectric sheet delays the deforming timing of the lowermost piezoelectric sheet from that of the other piezoelectric sheets. Accordingly, deforming movement of the other piezoelectric sheets in response to the ejection voltage applies pressure to and deforms the lowermost piezoelectric sheet, and subsequently the lowermost piezoelectric sheet deforms spontaneously in response to the ejection voltage. This difference in the deforming timings affects pressure change in the pressure chamber, whereby ink ejection performance becomes unstable. Moreover, when lowermost piezoelectric ceramic sheet and/or the adhesive layer have an uneven thickness, the difference in the deforming timings varies even within the single lowermost piezoelectric sheet, further degrading ink ejection performance.

It should be noted that although the lowermost piezoelectric sheet sandwiched between the drive electrodes and the cavity unit rather than between the drive electrodes and the common electrode does not theoretically have active portions that spontaneously deform when an ejection voltage is applied to the drive electrodes formed thereon, the lowermost piezoelectric sheet is in fact polarized and thus deform spontaneously, which is for the existence of the ink in the pressure chamber and of the cavity unit.

It is an object of the present invention to overcome the above problems and to provide an inkjet printer head with a stable ink ejection performance.

In order to achieve the above and other objectives, there is provided an inkjet head including a cavity unit, an actuator, and a conductive member. The cavity unit is formed of a conductive material with a plurality of nozzles and a plurality of pressure chambers in fluid communication with the corresponding nozzles. The plurality of pressure chambers is aligned in a predetermined direction. The actuator includes a plurality of sheet members laminated one on the other in a lamination direction, a plurality of driving electrodes corresponding to the pressure chambers, and a plurality of common electrodes. Each sheet member has a width greater than a total width of the plurality of pressure chambers with respect to the predetermined direction. The plurality of driving electrodes and the plurality of common electrodes are arranged in alternation with respect to the lamination direction. Each of the driving electrodes and the common electrodes is sandwiched between corresponding sheet members. Portions of the sheet members sandwiched between the driving electrodes and the common electrodes serve as active portions that selectively eject ink droplets from the corresponding pressure chambers through the nozzles. The conductive member electrically connects the common electrodes and the cavity unit for maintaining the common electrodes at the same potential as the cavity unit. One of the sheet members has a first surface on which one of the common electrodes is formed and a second surface attached to the cavity plate.

There is also provided an inkjet head including a cavity unit, an actuator, and a conductive member. The cavity unit is formed of an electrically conductive material with a plurality of nozzles and a plurality of pressure chambers in one-to-one correspondence with the nozzles. The nozzles are aligned in a predetermined direction. The actuator is attached to the cavity unit and includes a plurality of sheets laminated one on the other and a plurality of drive electrodes positioned between corresponding sheets. The sheets have a width greater than a total width of the pressure chambers with respect to the predetermined direction. The drive electrodes correspond to the pressure chambers. The conductive member grounds the cavity unit. Plural ones of the drive electrodes located closest to the cavity unit confront the cavity unit with more than one of the sheets interposed between the plural ones of the drive electrodes and the cavity unit.

PREFERRED EMBODIMENTS OF THE PRESENT INVENTION

Next, preferred embodiments of the present invention will be described while referring to the attached drawings.

Figure 1:
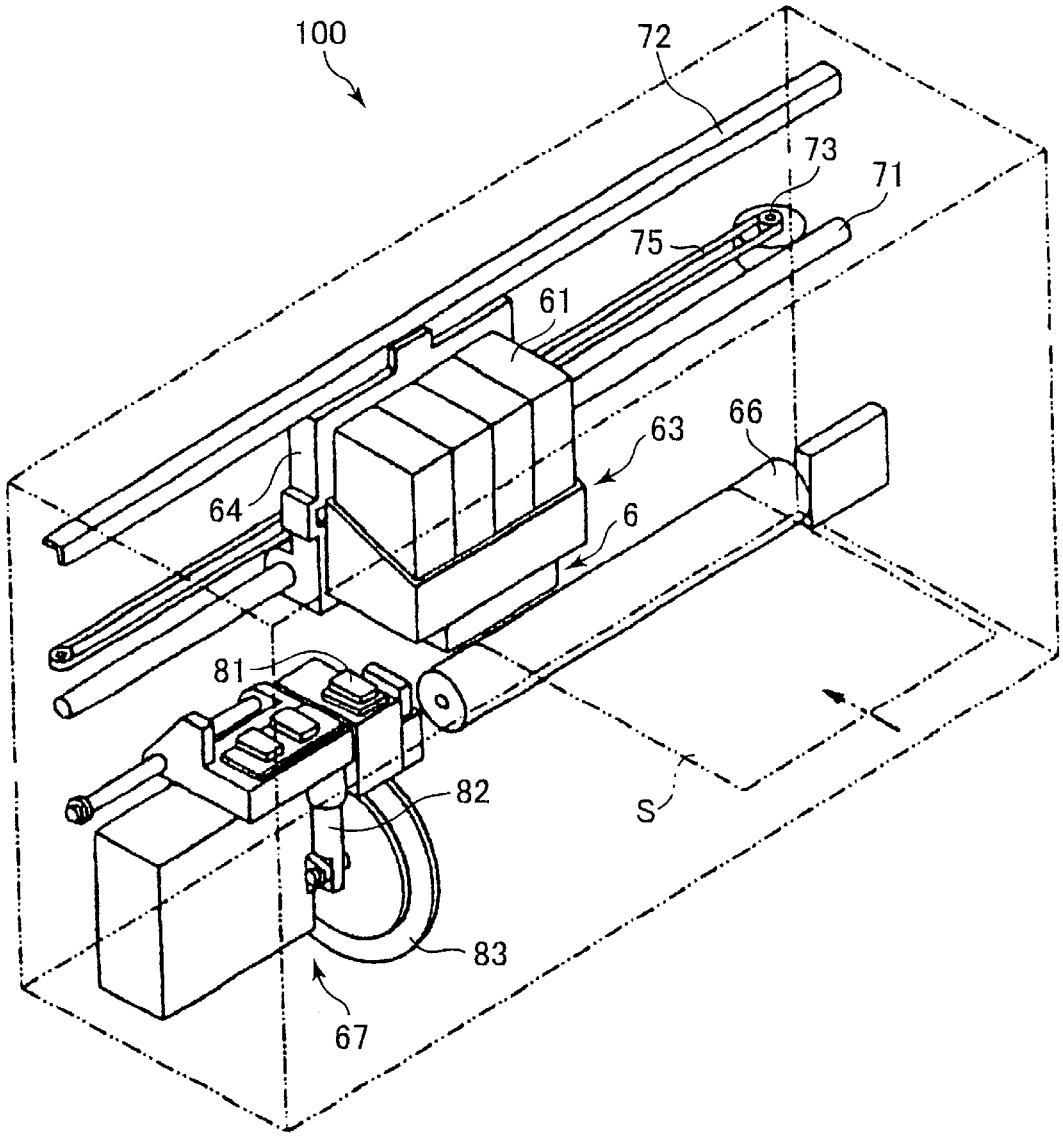
FIG. 1 is a perspective view showing internal configuration of an inkjet printer including inkjet printer heads according to a first embodiment of the present invention.

FIG. 1 shows a color inkjet printer 100 mounting piezoelectric inkjet printer heads 6 according to a first embodiment of the present invention. The piezoelectric inkjet printer head 6 ejects ink droplets through nozzles 54 (FIG. 2) for forming images on a recording sheet S. First, an overall configuration of the color inkjet printer 100 will be described.

As shown in FIG. 1, the color inkjet printer 100 includes a carriage 64 that mounts a head unit 63 and ink cartridges 61. The head unit 63 includes a pair of piezoelectric inkjet printer heads 6. The carriage 64 is connected to an endless belt 75.

When a motor (not shown) drives a pulley 73 to rotate in forward and reverse directions, the carriage 64 moves reciprocally in association with forward and reverse movement of the pulley 73 and linearly following a carriage shaft 71 and a guide plate 72.

Although not shown in the drawings, the color inkjet printer 100 is also provided with a sheet supply mechanism, a sheet discharge mechanism, and a cassette. The cassette is provided at the side of the printer 100 and mounts the recording sheets thereon. The sheet supply mechanism introduces the recording sheets S mounted on the cassette one at a time to a position between the piezoelectric inkjet printer heads 6 and a platen roller 66. After the piezoelectric inkjet printer heads 6 form characters and the like onto the recording sheet S, the sheet discharge mechanism discharges the recording sheet S out of the printer 100.

A purge unit 67 is provided to the side of the platen roller 66. The purge unit 67 includes a cap 81, a pump 82, and a cam 83, and performs a purging operation on the printer heads 6 in order to recover the printer heads 6 to a good condition when the head unit 63 is in a prescribed reset position. In the purging operation, the cap 81 covers over the nozzles 54 of the piezoelectric inkjet printer heads 6. Then, the cam 83 drives the pump 82 to suck defective ink containing bubbles and the like from the inkjet printer heads 6 through the nozzles 54.

Next, detailed description will be provided for the head unit 63.

Figure 4:
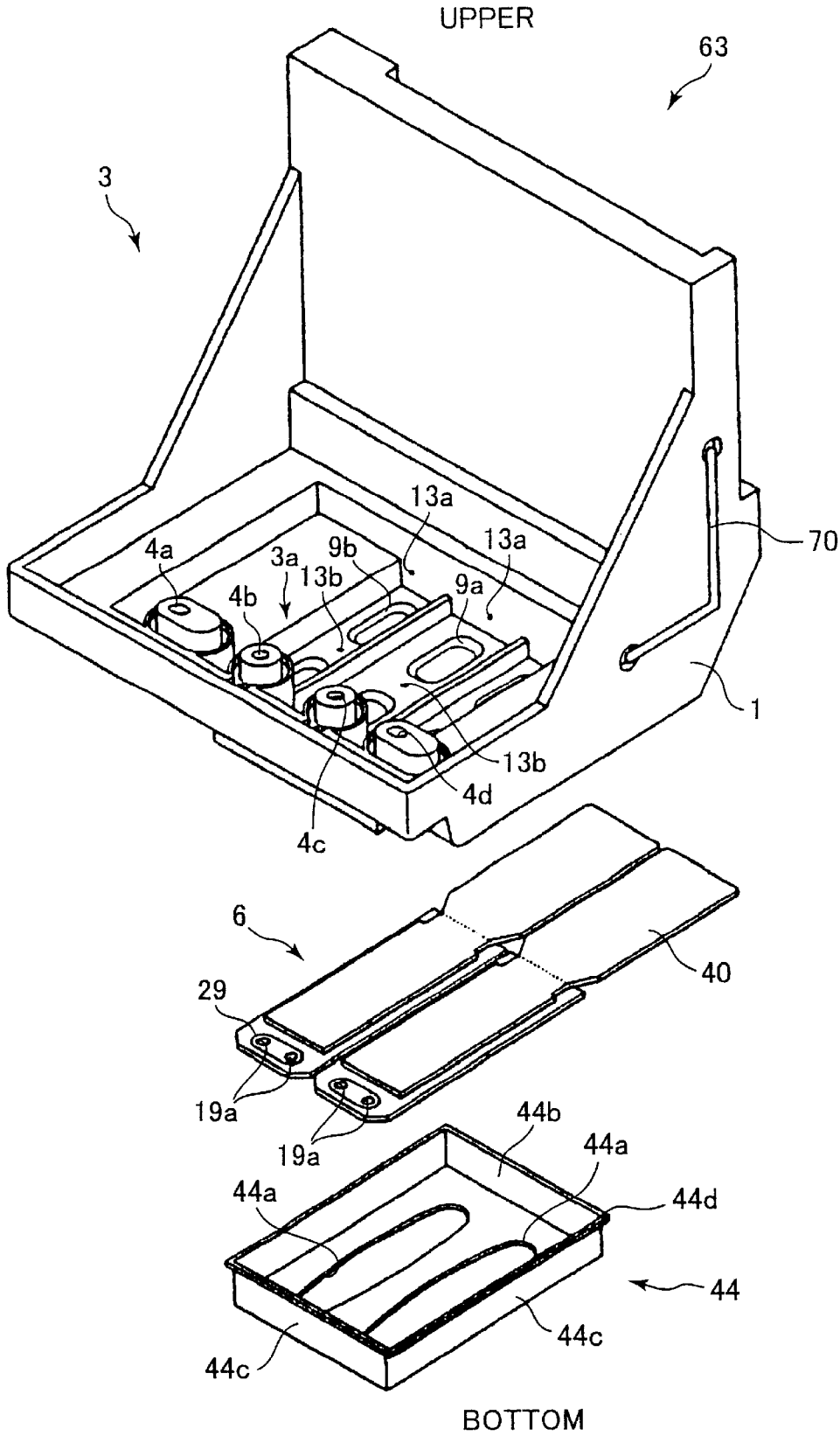
FIG. 4 is an exploded perspective view showing the upper portion of the head unit of FIG. 2.

As shown in FIG. 4, the head unit 63 includes a frame 1, the printer heads 6, and a cover plate 44. The frame 1 is mounted on the carriage 64 and is formed of compound resin, such as polyproethylene or polypropylene, by ejection molding. The frame 1 has a substantial box shape with the upper part open, where a mounting portion 3 is formed for mounting the ink cartridges 61 in a freely detachable manner. The frame 1 includes a bottom wall 3*a* formed with ink supply holes 4*a*, 4*b*, 4*c*, 4*d* penetrating therethrough. Although not shown in the drawings, the cartridges 61 are formed with an ink outlet portion to which the corresponding ink supply hole 4*a*, 4*b*, 4*c*, 4*d* is connected. Also, packing is provided at the outer periphery of the ink supply holes 4*a*, 4*b*, 4*c*, 4*d* for developing an intimate sealed condition with the ink outlet portion of the ink cartridges 61. The packing can be made from rubber, for example.

Figure 3:
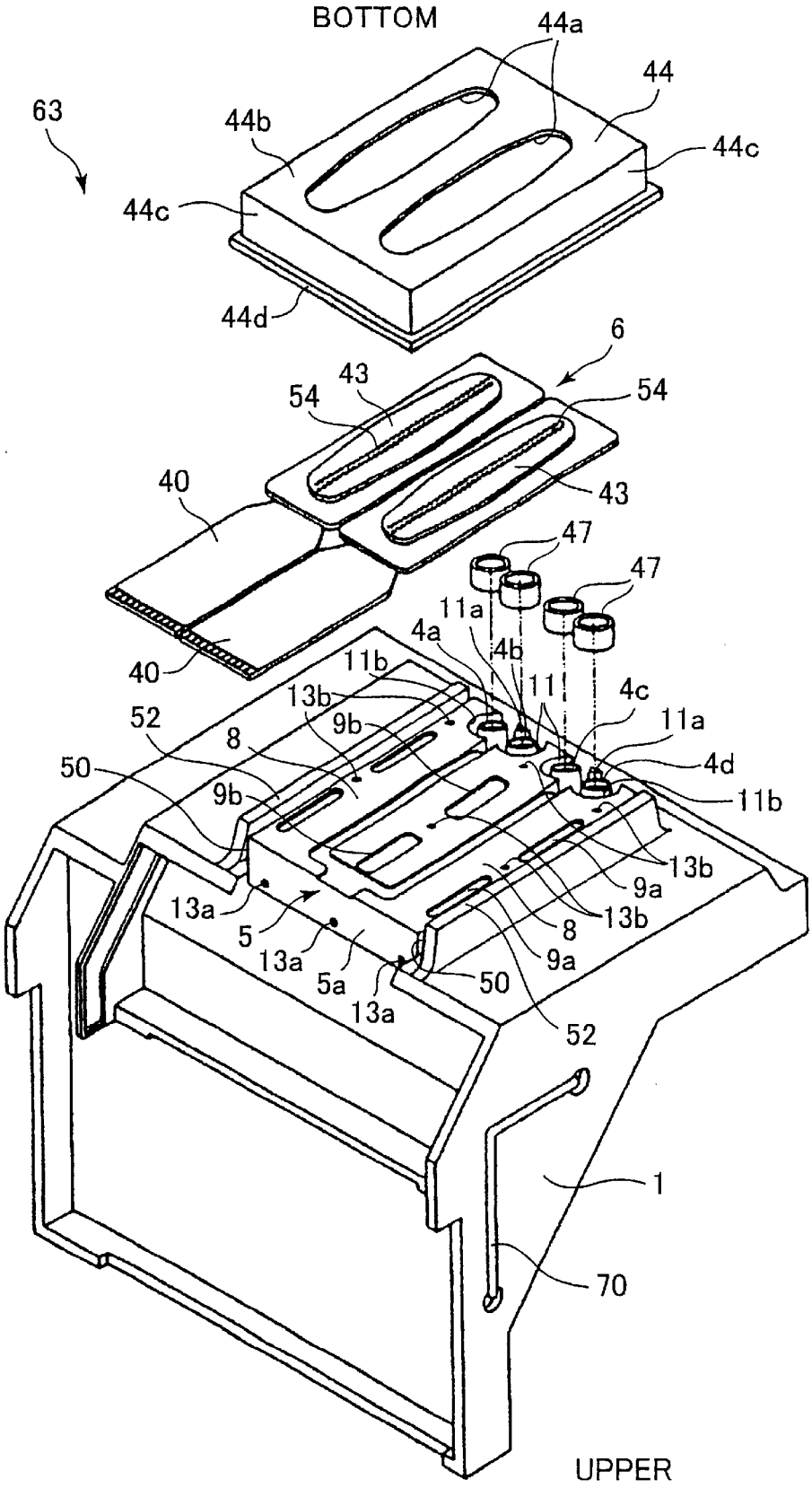
FIG. 3 is an exploded perspective view showing the head unit of FIG. 2.

As shown in FIG. 3, the bottom wall 3*a* includes a bottom plate 5 provided to its bottom side. The bottom plate 5 has a flat surface and protrudes downward from the rest of the mounting portion 3. Two support portions 8, 8 are formed in the bottom plate 5 for supporting the piezoelectric inkjet printer heads 6 thereon. A plurality of empty portions 9*a*, 9*b* are formed penetrating through the support portions 8, 8 for holding a UV adhesive that fixes the piezoelectric inkjet printer heads 6 in place.

8-shaped engagement grooves 11 are formed surrounding the ink supply holes 4*a*, 4*b*, 4*c*, 4*d*. Ring-shaped packing 47 formed of rubber or the like are inserted into the engagement grooves 11. When the piezoelectric inkjet printer heads 6 are fixed to the frame 1, the tip end of the packing 47 is pressed to the outer periphery of an inlet port 19*a* (FIGS. 4 and 6) of the piezoelectric inkjet printer heads 6 for developing an intimate sealed condition with the inlet port 19*a*.

Figure 6:
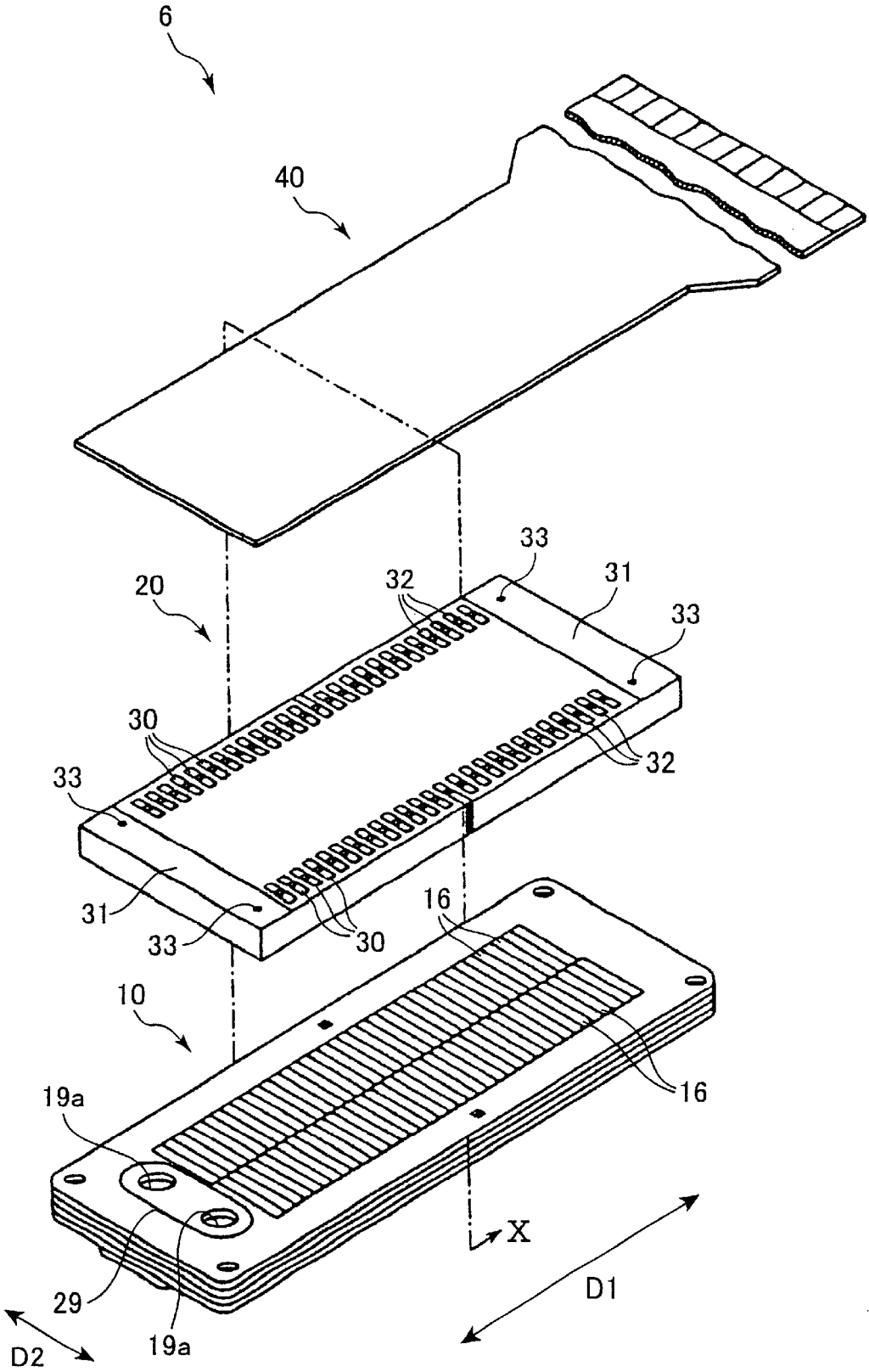
FIG. 6 is an exploded perspective view showing the inkjet printer head.
Figure 7:
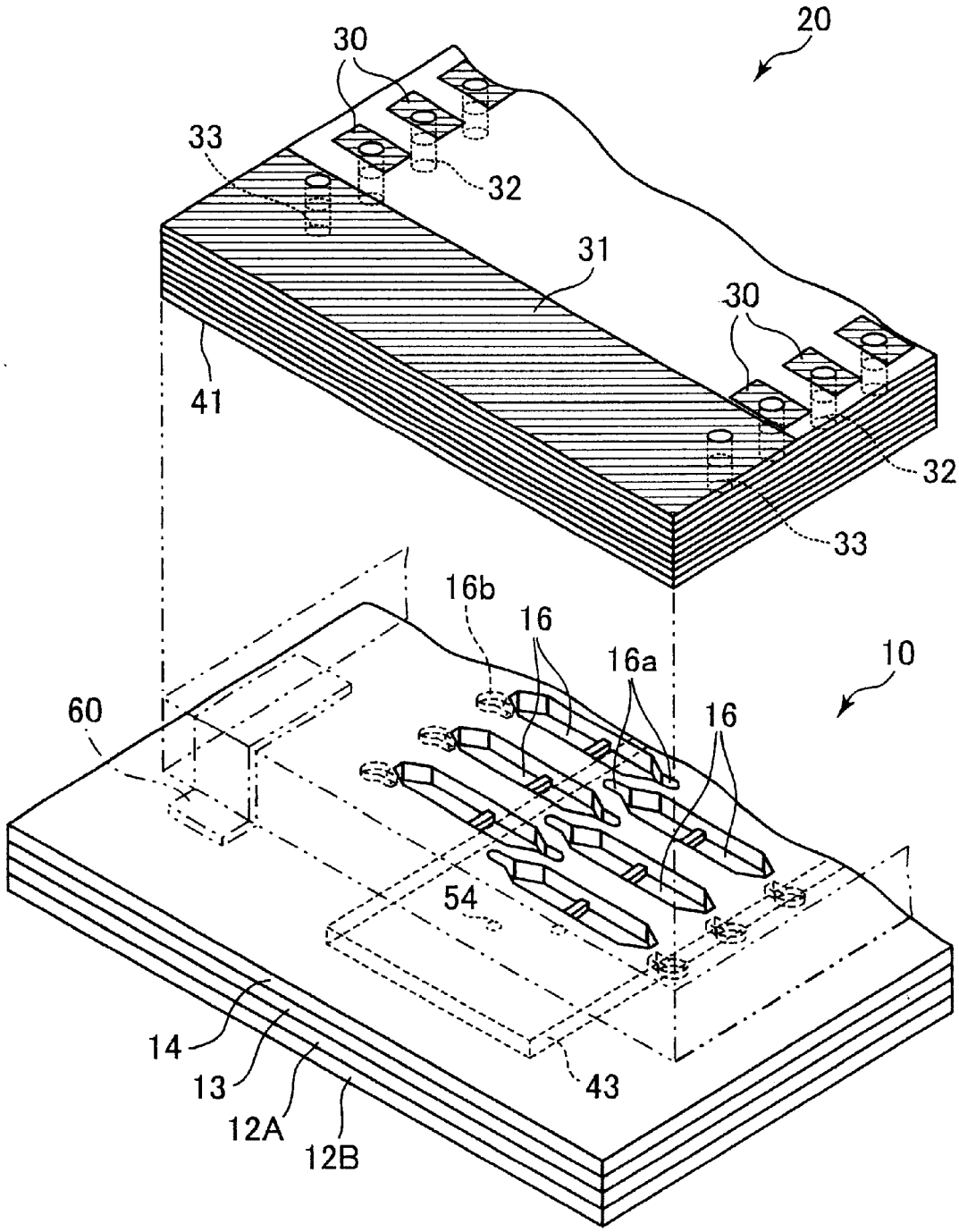
FIG. 7 is an exploded perspective view showing the inkjet printer head.

As shown in FIG. 6, each piezoelectric inkjet printer head 6 includes a cavity unit 10, a plate-shaped piezoelectric actuator 20, and a flexible flat cable 40. The cavity unit 10 is a stack of a plurality of layers. The actuator 20 is adhered in a stacked condition onto the cavity unit 10. The flexible flat cable 40 is stacked on the actuator 20 and electrically connected to external equipment. As shown in FIG. 7, the cavity plate 10 includes a nozzle plate 43 at its bottom end. The nozzle plate 43 is formed with the nozzles 54 through which ink is ejected downward.

As shown in FIGS. 2 to 5, the cover plate 44 formed of conductive thin metal plate is placed to cover the printer heads 6, and includes a bottom wall 44*b* and side walls 44*c* extending upward from the edges of the bottom wall 44*b* to form a box shape. The bottom wall 44*b* is formed with a pair of openings 44*a* through which the nozzle plates 43 of the printer heads 6 are exposed outside. Flanges 44*d* is formed to protrude from tip ends of the sidewalls 44*c*.

Figure 2:
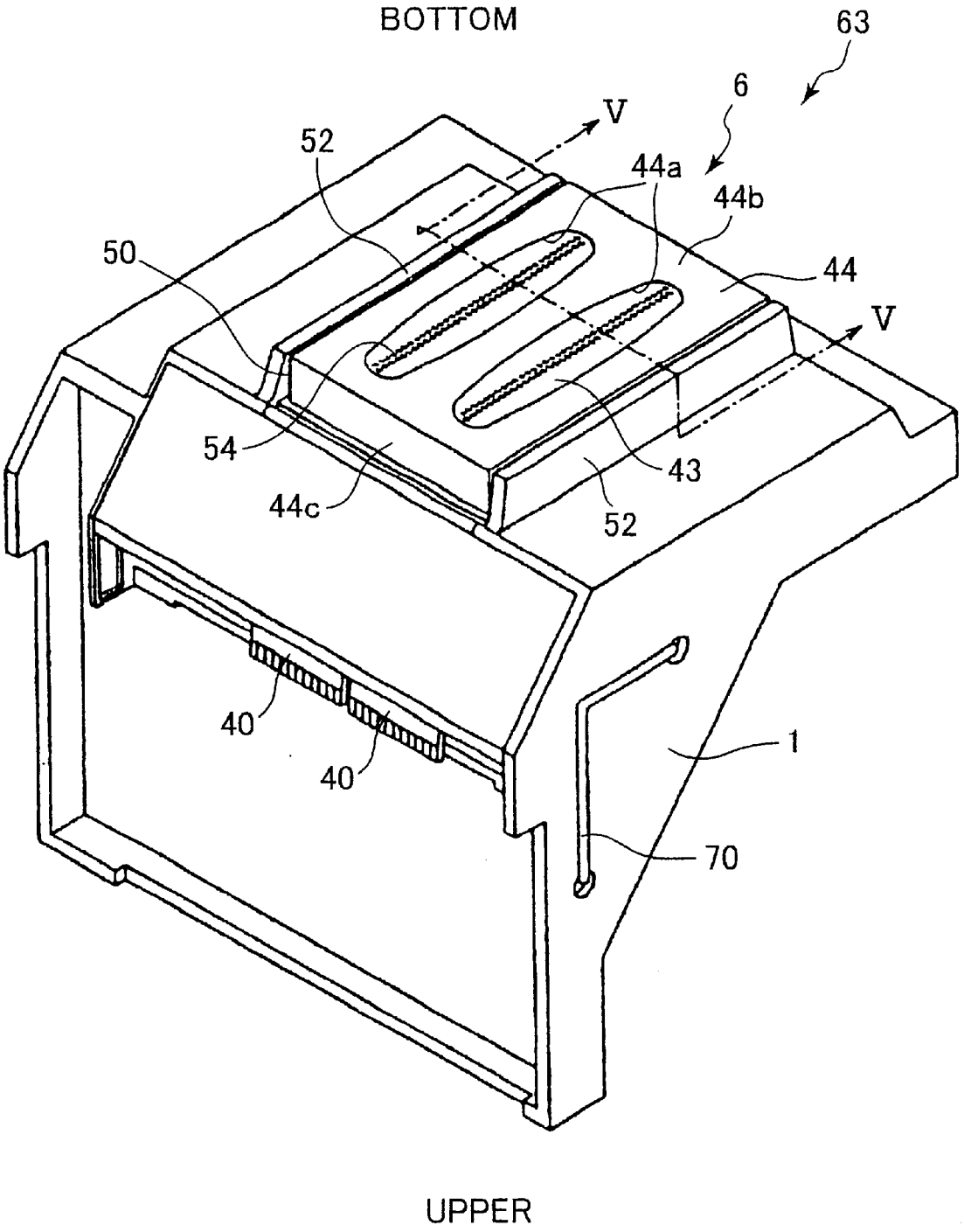
FIG. 2 is a perspective view showing the bottom of a head unit of the inkjet printer of FIG. 1.
Figure 5:
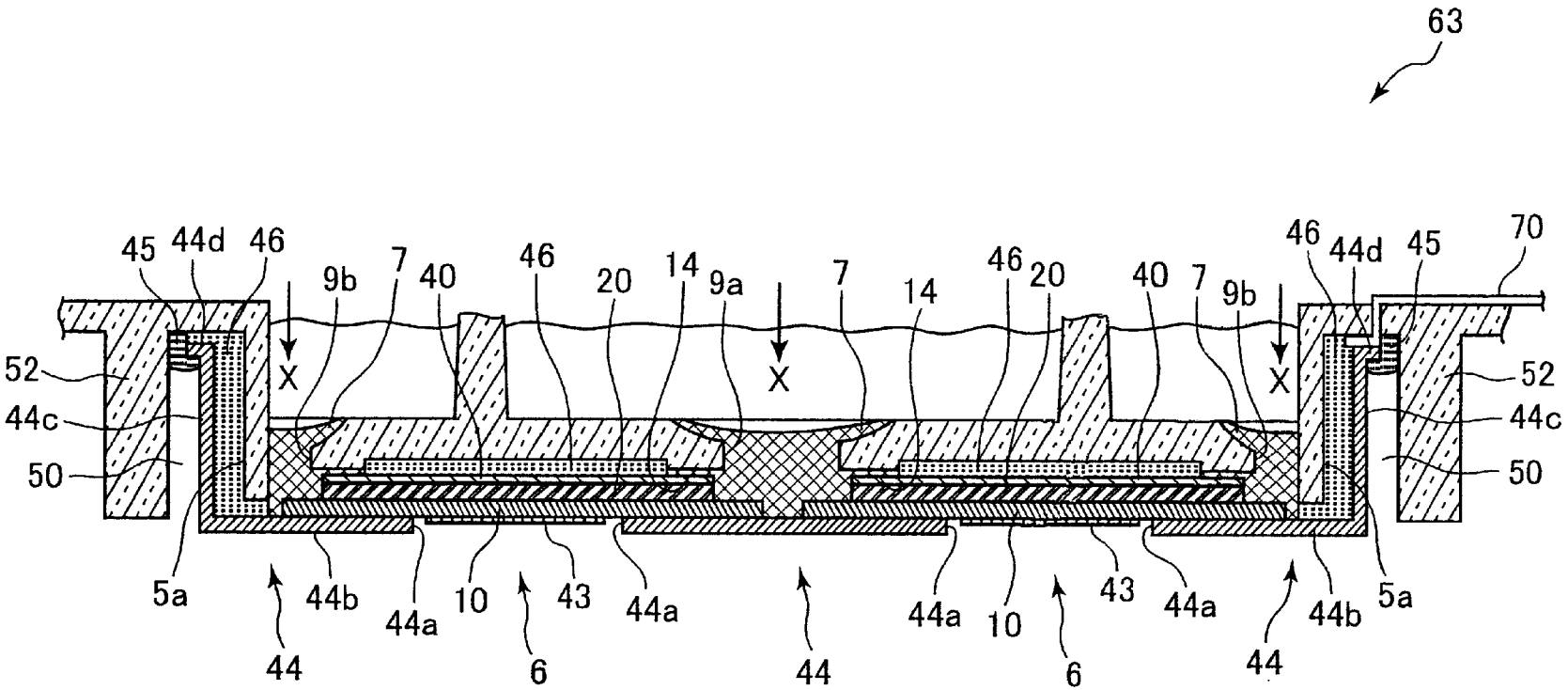
FIG. 5 is a cross-sectional partial view of the head unit taken along a line V—V of FIG. 2.

As shown in FIG. 2, 3, and 5, the frame 1 is formed with a pair of ribs 52, 52 each facing a corresponding side surface 5*a* of the bottom plate 5, defining the grooves 50 therebetween for receiving the side walls 44*c* and the flanges 44*d* of the cover plate 44. Although not shown in the drawings, the frame 1 is also formed with a groove connected to the grooves 50 so as to extend along one of side surfaces of the bottom plate 5 adjacent to the side surfaces 5*a*. This groove and the grooves 50 connected thereto together define an approximate U-shaped single groove. As shown in FIG. 2, a conductive wire 70 is provided on a side surface of the frame 1. As shown in FIG. 5, one end of the conductive wire 70 is placed on the bottom of the groove 50 so as to contact the flange 44*d* of the cover plate 44, and another end (not shown) is grounded.

Next, a process for fixing the printer heads 6 to the frame 1 and to the cover plate 44 will be described. First, the pair of printer heads 6, 6 is adhered to the cover plate 44 with the nozzle plates 43 facing the openings 44*a*, 44*a* by a sealing agent. Then, as shown in FIG. 4, the frame 1 is placed over the printer heads 6, 6 onto the flexible flat cable 40 from the above, that is, from the side opposite from the cover plate 44 such that the support portions 8, 8 (FIG. 3) are brought into one-to-one correspondence with the printer heads 6, 6 and that the side walls 44*c* of the cover plate 44 are inserted into the grooves 50 as shown in FIG. 5. Then, as shown in FIG. 5, a fast-cure type UV adhesive 7 is applied and filled into the empty portions 9*a*, 9*b* of the frame 1 as indicated by arrows X in FIG. 5. The UV adhesive 7 is an electrically insulating viscosity adhesive, such as modified acrylic resin adhesive. An ultraviolet light is irradiated from the above onto the empty portions 9*a*, 9*b* to cure the UV adhesive 7, thereby fixing the printer heads 6, 6 to the frame 1.

Then, as shown in FIG. 2, the frame 1, the resultant product is placed upside down, that is, with the nozzles 54 facing upward. Next, as shown in FIG. 5, a sealing agent 45 is applied on the flanges 44*d* and between the ribs 52 and the sidewalls 44*c*, thereby sealing the periphery of the cover plate 44.

An electrically-insulating filler 46, such as silicon, is applied and filled into internal spaces defined between the frame 1 and the cover plate 44, through the U-shaped groove formed of the grooves 50 and the groove connected to the grooves 50 described above. In this manner, the peripheries of the printer heads 6. 6 are sealed. At the same time, the filler 46 also seals the bottom of the grooves 50 with the one end of the conductive wire 70 in connection with the flange 44*d*. Excessive filler 46 flows out of the head unit 63 via discharging ports 13*a*, 13*b* shown in FIG. 3.

Next, detailed description for the printer head 6 will be provided. As described above, the printer head 6 includes the cavity unit 10, the piezoelectric actuator 20, and the flexible flat cable 40. As shown in FIGS. 7 to 10, the cavity unit 10 includes five electrically conductive thin plates connected in a laminated manner by adhesive. The five plates include the nozzle plate 43, a damper plate 12B, a manifold plate 12A, a spacer plate 13, and a cavity plate 14 in this order from the bottom side. The plates 12B, 12A, 13, 14 have a thickness of between 50 $\mu$m to 150 $\mu$m and are formed from a 42% nickel-alloy steel.

Figure 9:
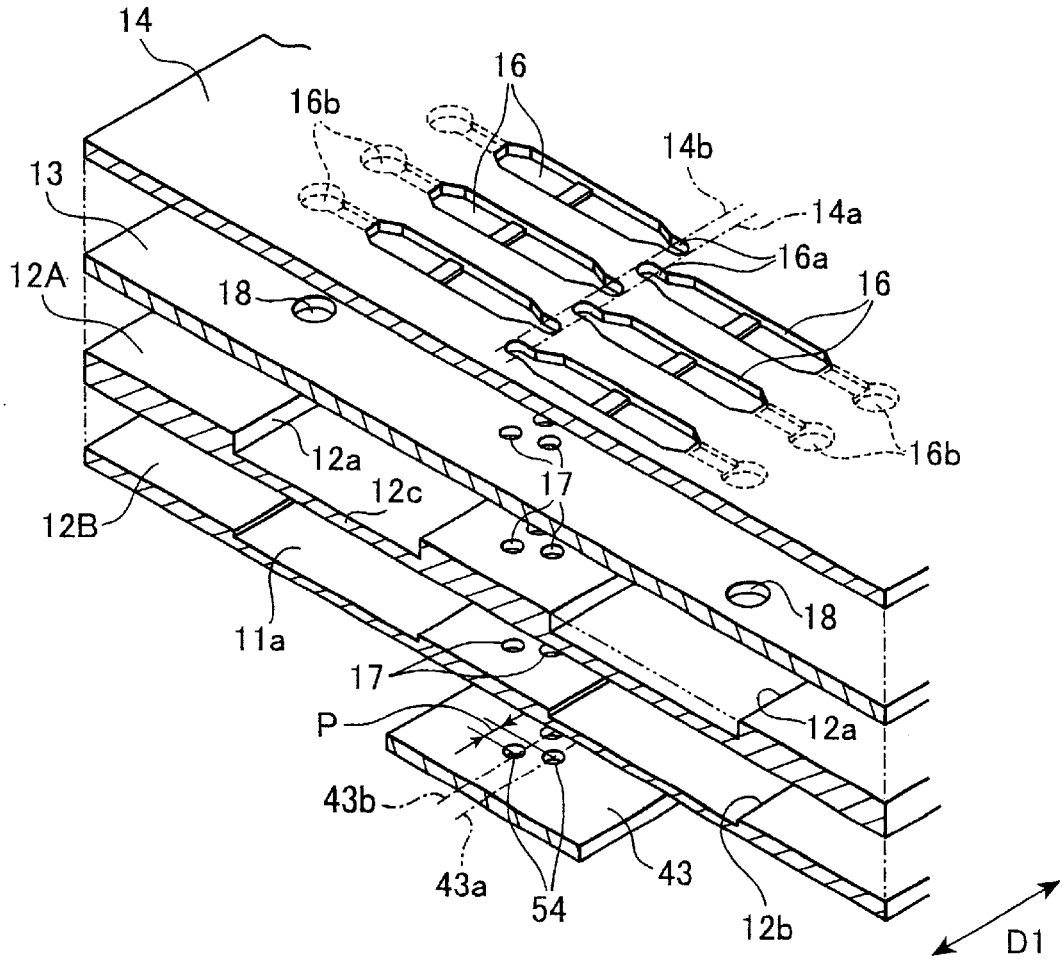
FIG. 9 is a magnified exploded perspective partial view showing the cavity plate of FIG. 8.

The nozzle plate 43 is formed with the plurality of nozzles 54, through which ink droplets are ejected. As shown in FIG. 9, the nozzles 54 are formed separated from each other by a pitch P in two rows aligned following central imaginary lines 43*a*, 43*b* that extend in a lengthwise direction D1. The rows of nozzles 54 are shifted slightly in the lengthwise direction D1 to give the nozzles 54 a staggered arrangement.

Narrow-width pressure chambers 16 are formed in the cavity plate 14 in two rows that extend parallel with imaginary lines 14*a*, 14*b*, which extend in the center of the cavity plate 14 following the lengthwise direction D1 of the cavity plate 14. Tip ends 16*a* of right-sided pressure chambers 16 are located on the line 14*b*, whereas tip ends 16*a* of left-sided pressure chambers 16 are located on the line 14*a*. A groove 16*b* is formed in a lower surface of the cavity plate 14 at one end of each pressure chamber 16. As shown, the right-sided pressure chambers 16 and the left-sided pressure chambers 16 are arranged in alternation in the direction D1 so as to give the pressure chambers 16 a staggered arrangement.

Figure 8:
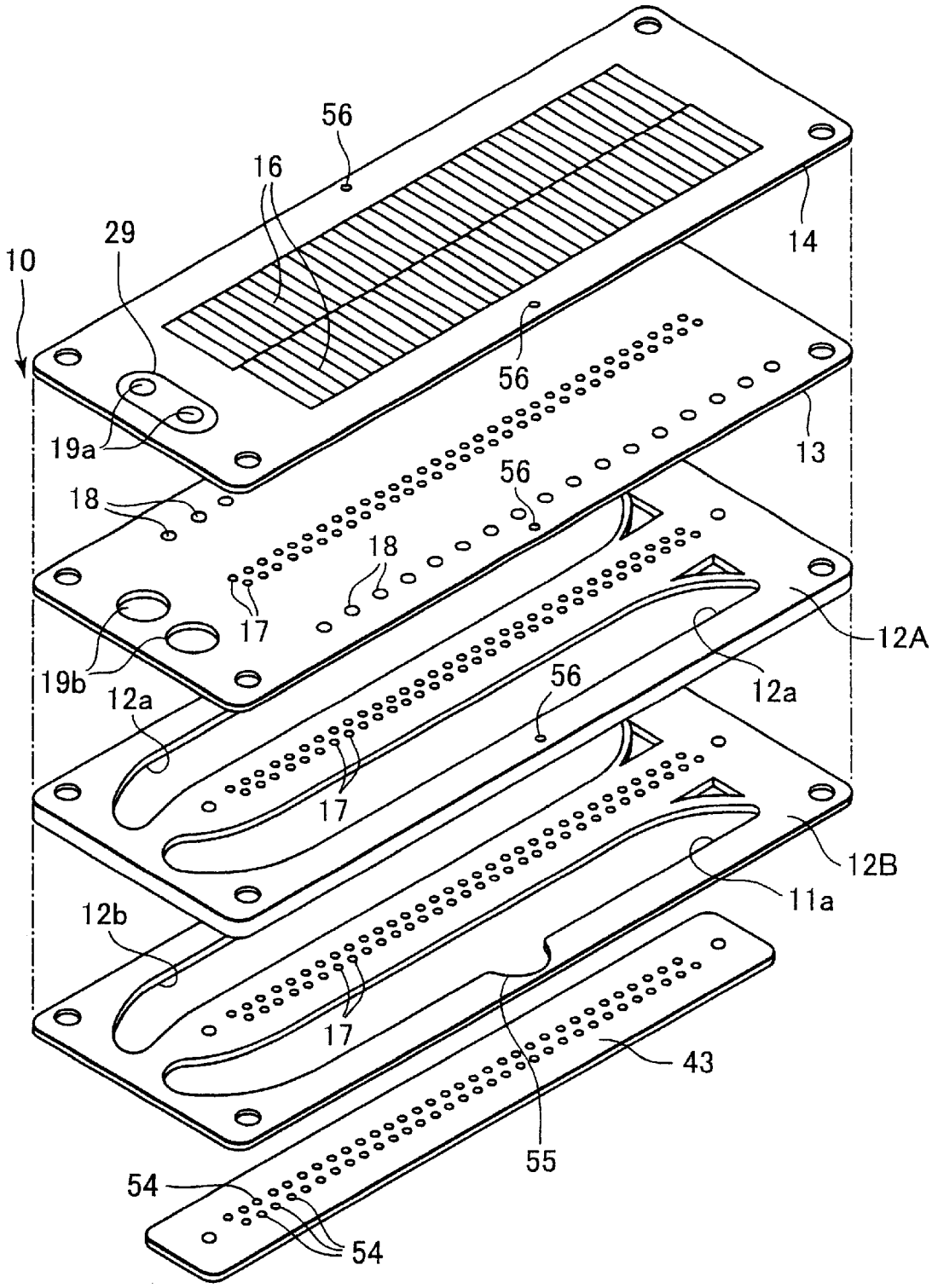
FIG. 8 is an exploded perspective view showing a cavity plate of the inkjet printer head.

Small-diameter through holes 17 are formed through the spacer plate 13, the manifold plate 12A, and the damper plates 12B, in the same staggered arrangement as the nozzles 54. The tip end 16*a* of each pressure chamber 16 is in fluid communication with one of the nozzles 54 through the corresponding through holes 17. As shown in FIG. 8, ink supply holes 19*a*, 19*b* are formed through the cavity plate 14 and the spacer plate 13, respectively, in a vertical alignment. A filter 29 is attached onto the upper surface of the cavity plate 14 for covering over the ink supply holes 19*a*. Ink supply holes 18 are formed through the left and right sides of the spacer plate 13 at positions vertically aligned with the ink supply holes 16*b*.

Figure 10:
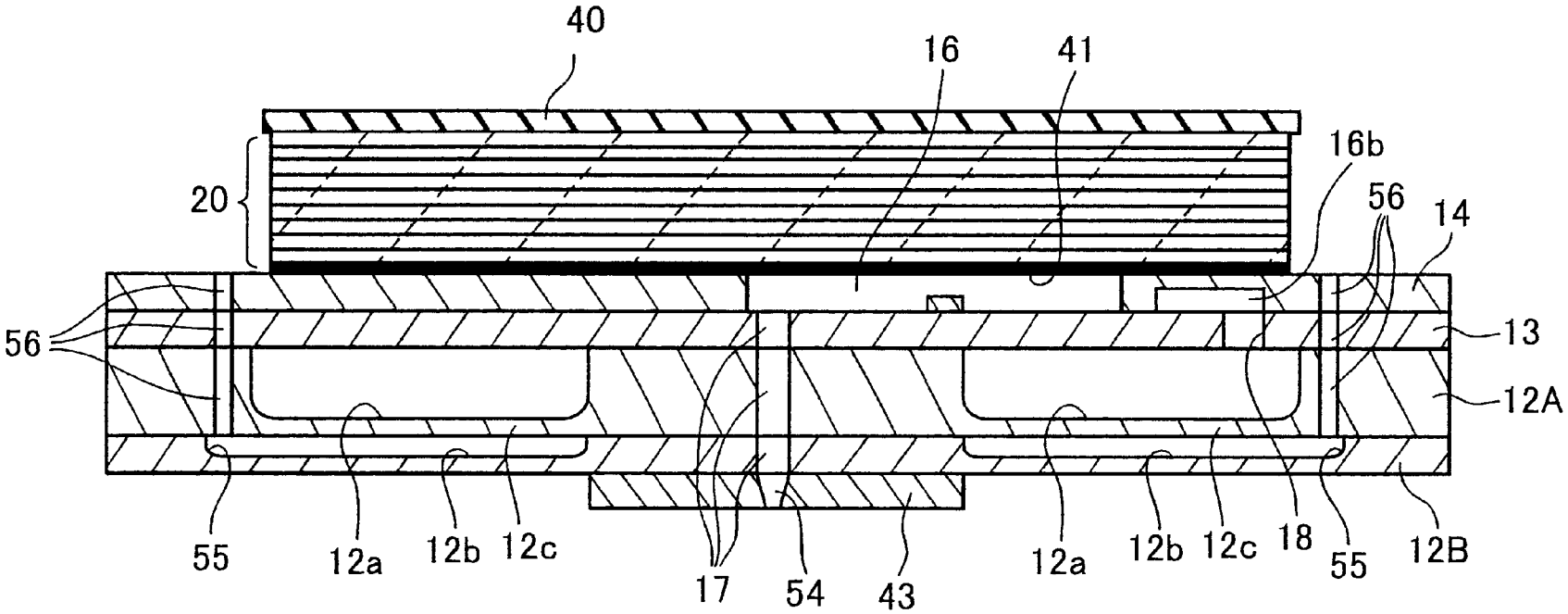
FIG. 10 is a cross-sectional view of the inkjet printer head taken along a line X of FIG. 6.

The manifold plate 12A is formed with a pair of manifold chambers 12*a*, 12*a* at positions sandwiching the rows of through holes 17. These manifold chambers 12*a* have a thin bottom wall 12C and are brought into sealed condition when the lower surface of the spacer plate 13 is adhered to the upper surface of the manifold plate 12A as shown in FIG. 10. As shown in FIG. 8, a pair of damper chambers 12*b*, 12*b* are formed in the upper surface of the damper plate 12B at positions corresponding to the manifold chambers 12*a* while sandwiching the rows of through holes 17. When the manifold plate 12A and the damper plate 12B are adhered together, the manifold chambers 12*a* are separated from the damper chambers 12*b* by the bottom walls 12C. Each damper chamber 12*b* is formed with a communication portion 55 extending outward from the outer periphery of the manifold chamber 12*a*.

A pair of air holes 56 are formed penetrating through the cavity plate 14, the spacer plate 13, the manifold plate 12A in the vertical alignment with the communication portions 55 of the damper chambers 12*b*. In this manner, the damper chambers 12*b* are connected to the air via the air holes 56. It should be noted that the position to form the air holes 56, i.e., the communication portion 55, should be selected such that the piezoelectric actuator 20, which is placed on the cavity plate 14, will not cover over and block off the air holes 56 formed in the cavity plate 14. The diameter of each air hole 56 needs to be small in order to facilitate the damper effect of the damper plate 12B. It is preferable that the air hole 56 have a diameter of 5 $\mu$m.

With this configuration, ink supplied from the ink cartridge 61 flows through the ink supply holes 19*a*, 19*b* into the manifold chambers 12*b*, distributed through the ink supply holes 18 and the ink supply holes 16*b* into the pressure chambers 16. The ink further flows toward the tip end 16*a* of the pressure chambers 16 and through the through holes 17 into the nozzles 54 corresponding to the pressure chambers 16.

Figure 11:
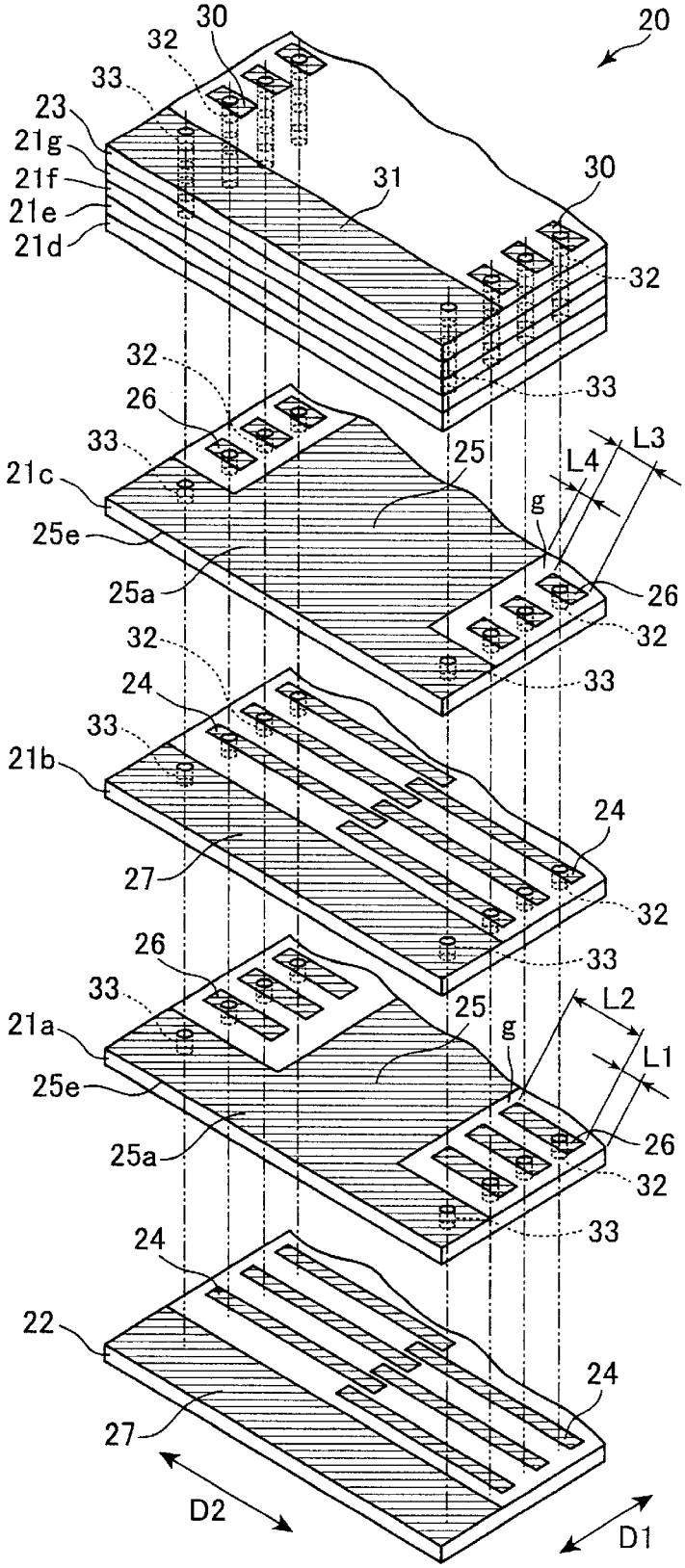
FIG. 11 is an exploded perspective view of end portion of a piezoelectric actuator of the inkjet printer head.
Figure 12:
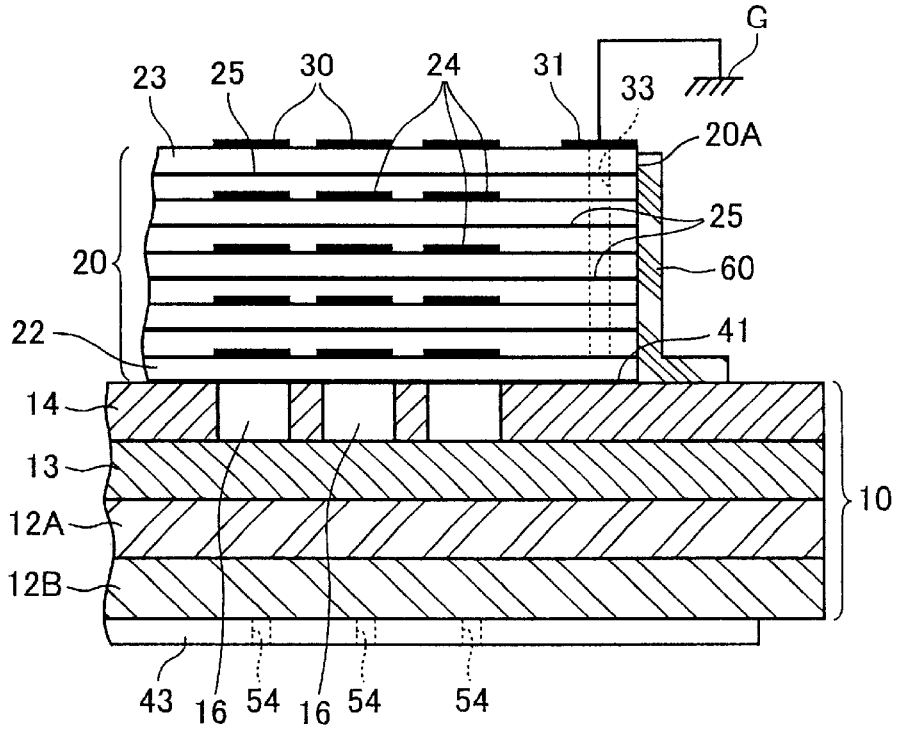
FIG. 12 is a cross-sectional view of the inkjet printer head.

Next, the actuator 20 will be described. As shown in FIGS. 7, 11, and 12, the actuator 20 is formed from nine piezoelectric sheets 22, 21*a*, 21*b*, 21*c*, 21*d*, 21*e*, 21*f*, 23 stacked in this order from the bottom to give a laminated configuration, each is made of ceramic and has a thickness of about 30 $\mu$m and a length greater than the entire width of the pressure chambers 16 in the direction D1. The lowermost sheet 22 and the uppermost sheet 23 could be formed of insulation material rather than piezoelectric ceramic material.

A plurality of drive electrodes 24 are attached onto upper surfaces of the odd-numbered piezoelectric sheets 22, 21*b*, 21*d*, 21*f* counted from the bottom. Each drive electrode is in vertical alignment with the corresponding pressure chamber 16 formed in cavity unit 10. That is, the drive electrodes 24 are arranged in two lines in the direction D1 to give a staggered arrangement in the same manner as the pressure chambers 16. The drive electrodes 24 have a narrow width in the direction D1 and an elongated length in the direction D2. In this embodiment, the width of the drive electrode 24 is set slightly narrower than the maximum width of the pressure chamber 16.

A band-shaped common electrode 25 is formed on the upper surface of each of the even-numbered piezoelectric sheets 21, 21*c*, 21*e*, 21*g* counted from the bottom, serving as a common electrode for all of the pressure chambers 16. The common electrode 25 has a dimension with sufficient width and length in the directions D1 and D2 for covering all of the pressure chambers 16. The common electrode 25 has lead-out parts 25*a* that have a length substantially equivalent to and extend along widthwise edges of the corresponding piezoelectric sheets 21*a*, 21*c*, 21*e*, 21*g* in the direction D2. A side edge 25*e* of the lead-out part 25*a* is exposed to a side surface 20A (FIG. 12) of the piezoelectric actuator 20 for reasons described later.

Dummy common electrodes 27 are provided on the upper surface of the odd-numbered piezoelectric sheets 22, 21*b*, 22*d*, 21*f* so as to vertically align with the lead-out parts 25*a* of the common electrodes 25.

A plurality of dummy electrodes 26 are provided on the upper surface of the even-numbered piezoelectric sheet 21*a*, 21*c*, 21*e*, 21*g* where the common electrode 25 is not provided. The dummy electrodes 26 are in vertical alignment with the corresponding drive electrodes 24, and have a width same as the width of and a length shorter than the length of the drive electrodes 24. The dummy electrodes 26 are located with a predetermined interval L1 from the longitudinal edge of the corresponding piezoelectric sheet 21*a*, 21*c*, 21*e*, 21*g*. In the present embodiment, the second and sixth piezoelectric sheets 21*a*, 21*e* from the bottom are provided with short dummy electrodes 26 with a length L2, whereas the fourth and eighth piezoelectric sheets 21*c* and 21*g* are provided with long dummy electrodes 26 with a length L3 so that the long dummy electrodes 26 and the short dummy electrodes 26 are arranged in alternation with respect to the vertical direction. In this manner, a gap g defined between the common electrode 25 and the dummy electrodes 26 will be in vertical alignment only in every other even-numbered sheets 21*a*, 21*c*, 21*e*, 21*g*. The length L3 is set equal to the sum of the length L2 and a length L4 of the gap On the upper surface of the top sheet 23, there are provided a plurality of surface electrodes 30 and surface electrodes 31 (FIG. 6) in correspondence with the drive electrodes 24 and the electrodes 25, respectively.

It should be noted that all the electrodes 24, 25, 26, 27, 30, 31 are formed by printing or the like.

All piezoelectric sheets 21*a* to 21*g* and the top sheet 23, except the lowermost piezoelectric sheet 22, are formed with through holes 32 in vertical alignment, penetrating through the surface electrodes 30, the drive electrodes 24, and the dummy electrodes 26, and also formed with through holes 33 in vertical alignment, penetrating through at least one of the surface electrodes 31 and also through the corresponding lead-out parts 25*a* and dummy electrodes 27. The through holes 32 and 33 are filled with conductive past for electrically connecting the drive electrodes 24 and the dummy electrodes 26 to the corresponding surface electrode 30 and to electrically connecting the common electrodes 25 and the dummy electrodes 27 to the surface electrode 31.

The piezoelectric actuator 20 having the above configuration is fixed to the cavity unit 10 and the flexible flat cable 40 in the following manner. As shown in FIG. 12, an adhesive sheet 41, which is formed of non-ink-permeable compound resin or the like, serving as an adhesive layer, is attached onto the entire bottom surface of the lowermost piezoelectric sheet 22. The material for the adhesive sheet 41 is non-ink-permeable and electrically insulative. Examples of such a material include a polyamide hot-melt adhesive including as main component a polyamide with a base of nylon or dimer acid, polyester hot-melt adhesive in a film shape, and the like.

Then, the bottom surface of the piezoelectric sheet 22 is fixedly adhered onto the cavity unit 10 such that the drive electrodes 24 vertically align with the pressure chambers 16. Here, the adhesive sheet 41 covers over all the pressure chambers 16. Then, as shown in FIG. 10, the flexible flat cable 40 is placed on top of the piezoelectric actuator 20 such that wiring pattern (not shown) on the flexible flat cable 40 is electrically connected to the surface electrodes 30 and 31. Alternatively, polyolefin hot-melt adhesive could be first applied over the entire bottom surface of the piezoelectric actuator 20, and then the bottom surface applied with the adhesive could be fixedly adhered onto the cavity unit 10. The thickness of the adhesive layer is about 1 $\mu$m to 3 $\mu$m.

Next, a voltage greater than an ejection voltage that is applied during normal printing operations is applied across all the drive electrodes 24 and the common electrodes 25 so as to polarize portions of the piezoelectric sheets 21 sandwiched between the drive electrodes 24 and the common electrodes 25 and portions of the lowermost piezoelectric sheet 22 sandwiched between the drive electrodes 24 and the cavity plate 10. Thus polarized portions serves as active portions which deform in the laminated (vertical) direction when the drive electrodes 24 are selectively applied with an ejection voltage. Because the active portions and corresponding pressure chambers 16 are in vertical alignment, displacement of the active portion decreases the internal volume of the corresponding pressure chamber 16, thereby increasing its internal pressure. Thus generated internal pressure propagates to the nozzle 54 and ejects an ink droplet through the nozzle 54. In this manner, printing is performed.

By providing the adhesive sheet 41 between the piezoelectric actuator 20 and the cavity unit 10 to cover all the pressure chambers 16 as described above, the adhesive sheet 41 serves as a coating means for preventing the ink from permeating to the piezoelectric actuator 20 side as well as serving as a bonding means for reliably fixing the piezoelectric actuator 20 and the cavity unit 10.

Because the piezoelectric actuator 20 is formed of the plurality of piezoelectric sheets 21 and 22, a sufficient deforming amount is obtained. Also, because each piezoelectric sheet 21, 22 has the dimension larger than total dimension of all the pressure chambers 16, even greater deforming amount is obtained. Moreover, the piezoelectric actuator 20 is provided in a simple manner by forming the electrodes by printing.

As shown in FIG. 12, an electrically conductive member 60 is formed on the top of the cavity unit 10 through the side surface 20A of the piezoelectric actuator 20 such that the side edges 25*e* of the common electrodes 25 exposed to the side surface 20A are electrically connected to the cavity plate 14. The surface electrode 31 is connected to the ground G. Because the surface electrode 31 is electrically connected to the common electrode 25 via the conductive past filling in the through holes 33, all the surface electrodes 31, the common electrodes 25, the cavity plate 14, and also ink inside the pressure chambers 16 are maintained at the same potential, i.e., 0V in this embodiment.

The electrically conductive member 60 could be an adhesive formed of a thermoplastic or thermosetting adhesive containing conductive filler, such as carbon black, metal powder, or metal oxide. Alternatively, the electrically conductive member 60 could be a metal plate.

With this configuration, the potential is maintained the same between the common electrode 25 and the cavity unit 10 (cavity plate 14) even when the drive electrodes 24 are applied with ejection voltage, so that the cavity plate 10 and the ink inside the pressure chambers 16 are not charged, thereby stabilizing the ink ejection performance of each pressure chamber 16.

As described above, according to the present embodiment, although the drive electrodes 24 on the lowermost piezoelectric sheet 22 is facing the conductive cavity unit 10 via only a single layer of the thin-thickness piezoelectric sheet 22, the voltage applied to the drive electrodes 24 is not conducted and applied to the cavity unit 10 or ink in the pressure chambers 16. This enables proper ink ejection while preventing ink ejection from unintended nozzles 54. Also, because the drive electrodes 24 formed on the lowermost piezoelectric sheet 22 confront the cavity plate 14 with only a single layer of the piezoelectric sheet, deforming movement of the piezoelectric sheets 21, 22 in response to the ejection voltage effectively change the volume of the pressure chambers 16 and thus effectively eject ink droplets.

Moreover, because the flanges 44*d* of the cover plate 44 is grounded via the conductive wire 70 as described above, the cover plate 44 is maintained at 0V as well as the common electrodes 25 and the cavity plates 10. Accordingly, the ink ejection performance of each pressure chamber 16 is further stabilized. Also, even if static electricity is generated by the recording sheet S contacting the cover plate 44, the cavity unit 10 are not charged, thereby preventing the piezoelectric inkjet printer head 6 from being damaged.

As described above, when the drive electrodes 24 are selectively applied with an ejection voltage, the piezoelectric sheets 21, 22 partially deform at the corresponding active portions. The displacement of the active portion increases internal pressure of the pressure chambers 16. The internal pressure propagates to the nozzle 54 and ejects an ink droplet through the nozzle 54.

Here, the internal pressure generated in the pressure chamber 16 also propagates to the manifold chambers 12*a*, in a direction retracting from the nozzles 54. Thus propagated pressure greatly vibrates the thin bottom walls 12C of the manifold chambers 12*a*. However, the air inside the damper chambers 12*b* positioned beneath the bottom walls 12C absorbs pressure fluctuation generated due to the vibration. Because the damper chambers 12*b* are connect to the open air through the air holes 56, pressure fluctuation hardly occurs in the air inside the damper chambers 12*a*. In this manner, it is possible to effectively absorb the pressure fluctuation generated in the manifold chambers 12*a* due to pressure propagation. This prevents cross-talk in an effective manner.

Because the damper chambers 12*b* are connected to the air through the air holes 56, even when the air inside the damper chambers 12*b* expands during the manufacturing process, where the plates 14, 13, 12A, 12B are fixedly adhered one on the other under a high temperature, it is possible to let out the expanded air through the air holes 56. Accordingly, thus expanded air is prevented from breaking the adhesive layer between the damper plate 12B and the manifold plate 12A.

Here, ink is vaporized at the time of ejection from the nozzles 54. If such vaporized ink enters the damper chambers 12*a*, the ink may corrode the manifold plate 12A and adhesive layer between the manifold plate 12A and the damper plate 12B due to chemical reaction and cause various other problems. However, according to the present embodiment, because the air holes 56 open at the upper end of the top sheet 23 which is farthermost side from the nozzles 54, vaporized ink is prevented from entering the damper chambers 12*b* through the air holes 56, preventing the above problems.

Figure 13:
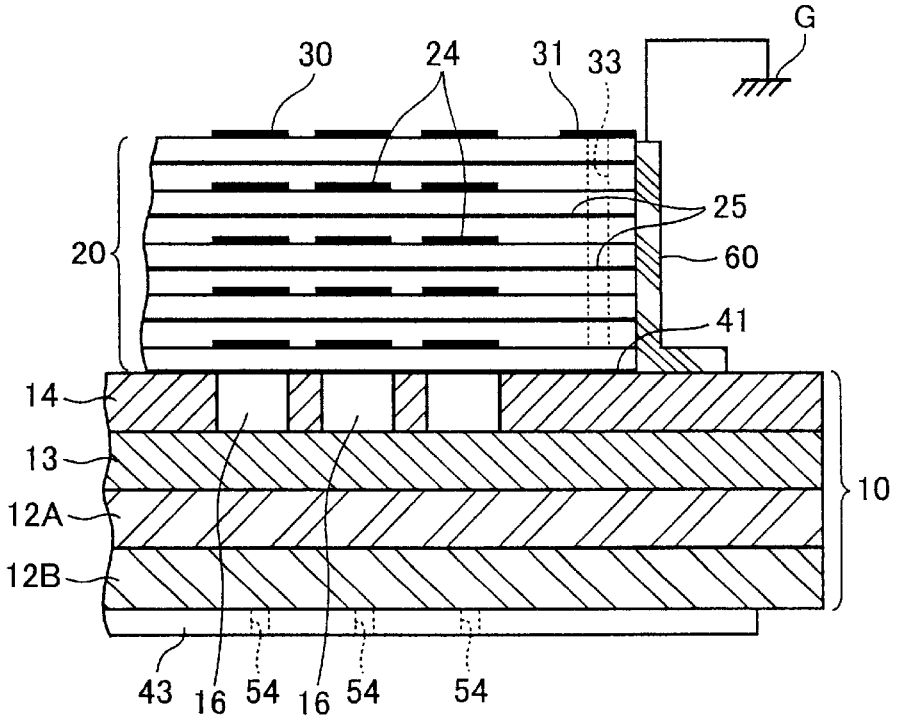
FIG. 13 is a cross-sectional view of an inkjet printer head according to a first modification of the first embodiment.

FIG. 13 shows a first modification of the first embodiment, wherein the electrically conductive member 60, rather than the surface electrode 31 is connected to the ground G. In this case also, the common electrodes 25 and the cavity unit 10 are maintained at 0V via the electrically conductive member 60.

Figure 14:
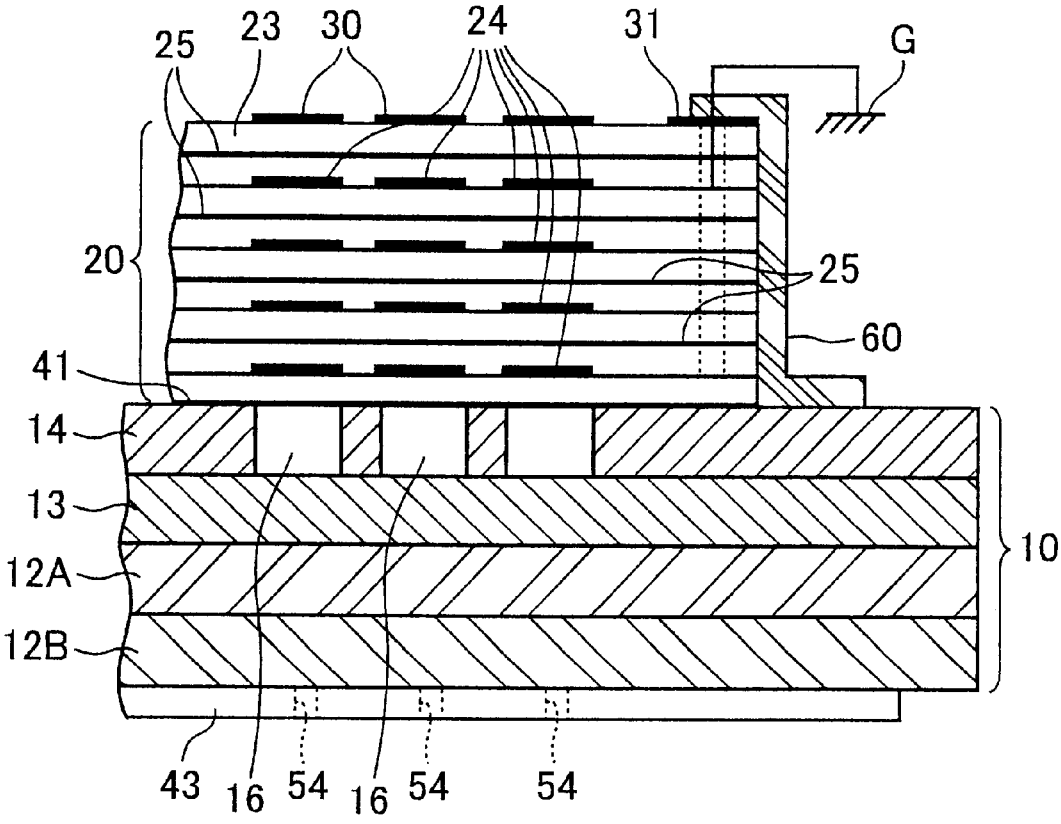
FIG. 14 a cross-sectional view of an inkjet printer head according to a second modification of the first embodiment.

FIG. 14 shows a second modification of the first embodiment, where the electrically conductive member 60 is extended for connecting with the surface electrode 31. In this case, without exposing the lead-out parts 25*a* of the common electrodes 25 to the side surface 20A of the piezoelectric actuator 20, all the common electrodes 25 are connected to the cavity unit 10 via the surface electrode 31 and the electrically conductive member 60.

Figure 15:
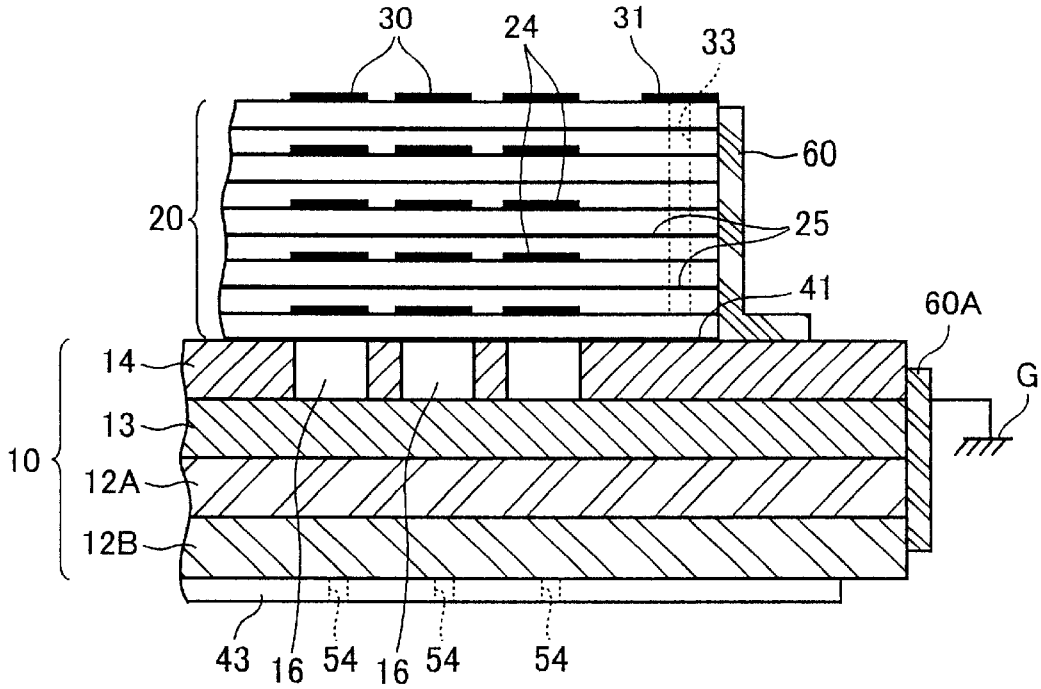
FIG. 15 is a cross-sectional view of an inkjet printer head according to a third modification of the first embodiment.

FIG. 15 shows a third modification of the embodiment, wherein in addition to the electrically conductive member 60, and a conductive member 60A is attached to the side surface of the cavity unit 10 for electrically connecting at least the cavity plate 14 to the ground G via a metal casing or conductive wire. The conductive member 60A could be a conductive metal plate, a conductive adhesive, or the like. The conductive member 60A could be attached to the upper surface of the cavity plate 14 rather than its side surface. The member 60A can be formed of the same material as that of the electrically conductive member 60.

It should be noted that the through holes 32 and 33 are not necessarily formed. In this case, the electrically conductive member 60 is formed also on the surface electrode 31 so as to electrically connect all the lead-out parts 25*a* to the surface electrode 31 and the cavity plate 14 via the electrically conductive member 60. In addition, all the drive electrodes 24 are exposed to one of the side surfaces of the piezoelectric actuator 20 at their ends and electrically connected to each other and also to the corresponding surface electrodes 30 via connecting electrodes provided on the side surface of the piezoelectric actuator 20.

Figure 16:
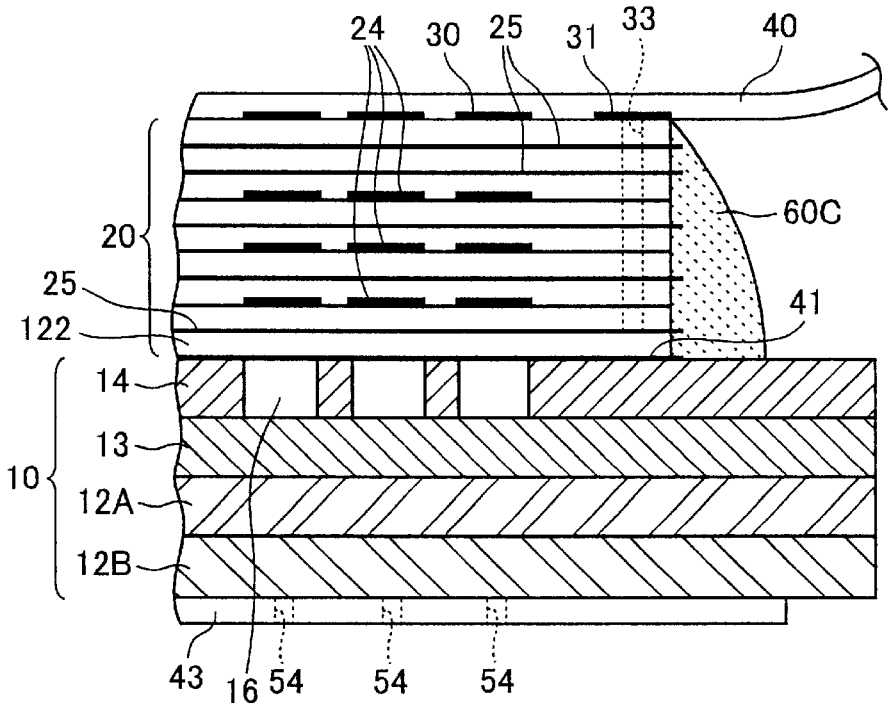
FIG. 16 is an exploded perspective view of end of a piezoelectric actuator of an inkjet printer head according to a second embodiment of the present invention.

Next, a piezoelectric actuator 120 according to a second embodiment of the present invention will be described while referring to FIGS. 16 and 17. Components same as those of the first embodiment will be assigned with the same numberings and explanation for those will be omitted in order to avoid duplication in explanation. FIG. 16 is an exploded perspective view of the piezoelectric actuator 120, and FIG. 17 is an explanatory cross-sectional view showing the piezoelectric actuator 120 attached to the cavity unit 10.

Figure 17:
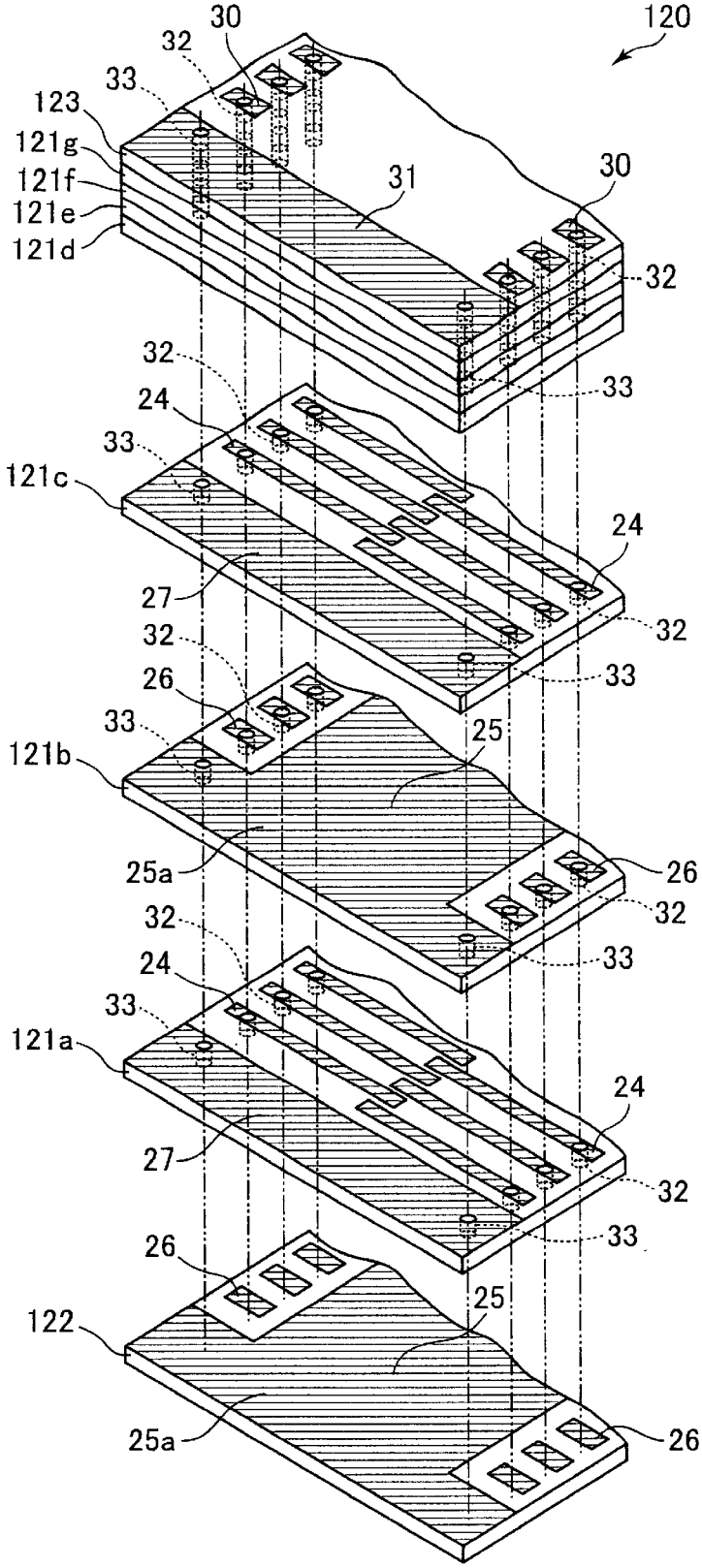
FIG. 17 is a cross-sectional view of the inkjet printer head according to the second embodiment of the present invention.

As shown in FIGS. 16 and 17, the actuator 120 is formed from nine piezoelectric sheets 122, 121*a*, 121*b*, 121*c*, 121*d*, 121*e*, 121*f*, 123 stacked in this order to give a laminated configuration, each has a length greater than the entire width of the pressure chambers 16 in the direction D1. A common electrode 25 is formed on the upper surface of each of the piezoelectric sheets 122, 121*b*, 121*d*, 121*f*, 121*g*. A plurality of drive electrodes 24 are formed the upper surface of each of the piezoelectric sheets 121*a*, 121*c*, 121*e*, 123.

In other words, the common electrode 25 is formed on the upper surface of the lowermost piezoelectric sheet 122, and the drive electrodes 24 and the common electrode 25 are arranged in alternation with respect to the vertical (lamination) direction, wherein the arrangement of the drive electrodes 24 and the common electrode 25 in this embodiment is in opposite from those o hf the first embodiment.

Also, the common electrode 25 rather than the drive electrodes 24 is formed on the upper surface of the piezoelectric sheet 121*g*. Because the piezoelectric sheet 121*g* and the like forming upper layers are sandwiched between the common electrodes 25 or between the common electrode 25 and the surface electrodes 31, 32, these upper layers including the piezoelectric sheet 121*g* are not polarized. Accordingly, the piezoelectric sheet 121*g* and the like do not deform, and, instead, serve to maintain the flat condition of the piezoelectric actuator 120 while preventing the same from being heaved when subjected to calcinations during manufacturing process.

As shown in FIG. 17, the piezoelectric actuator 120 having the above configuration is fixed to the cavity plate 14 such that a lower surface of the lower most piezoelectric sheet 122 opposite from the upper surface where the common electrode 25 is provided is attached to the cavity plate 14, in the same manner as that disclosed above. In other words, the lowermost common electrode 25, closest to the cavity plate 14, faces the pressure chambers 16 with the lowermost piezoelectric sheet 122 interposed therebetween.

The common electrodes 25, the cavity plate 14, and the cover plate 44 are maintained at the same potential (0V) even when the drive electrodes 24 are applied with ejecting voltage, in the similar manner as in the above described first embodiment.

As described above, the piezoelectric sheet 122 formed with the common electrode 25 is located between the cavity plate 14 and the lowermost drive electrodes 24 on the piezoelectric sheet 121*a*. In other words, the piezoelectric sheet 122 and 121*a* are interposed between the lowermost drive electrodes 24 and the cavity plate 14. Therefore, the driving voltage applied to the drive electrodes 24 is further reliably prevented from being conducted to ink or cavity plate 14 in comparison to the first embodiment where the lowermost drive electrodes 24 is located adjacent to the grounded cavity plate 14 with the 30 $\mu$m-thickness single piezoelectric sheet 22 interposed therebetween. Also, there is only a slight possibility that an electric short circuits is generated between the lowermost drive electrodes 24 and the cavity plate 14. Accordingly, problems that the piezoelectric sheets are cracked or peeled off due to short circuits can be prevented. This provides durable print head 6.

Further, because the piezoelectric sheet 122 formed with the common electrode 25 is located between the cavity plate 14 and the lowermost drive electrodes 24, the piezoelectric sheet 122 is not polarized at the time of when the piezoelectric sheets 121 are polarized. Accordingly, the polarizing process can be performed in a stable manner. Further, static-electricity will hardly accumulates in the cavity plate 14 and the ink because the components surrounding the cavity plate 14 and the ink are grounded, whereby improper ink ejection due to such an unnecessary static-electricity can be prevented.

In the above configuration, the lowermost piezoelectric sheet 122 is not polarized and thus has no active portions. Because the common electrode 25 on the lowermost piezoelectric sheet 122, the adhesive sheet 41, and the ink inside the pressure chambers 16 are all electrically connected to the ground G, spontaneous deformation does not occur in the lowermost piezoelectric sheet 122 even when ejection voltages are applied to the drive electrodes 24, although the piezoelectric sheet 122 is forced to deform when other piezoelectric sheets 121 deform in response to the ejection voltages. This contrasts to the above-described conventional printer head where the lowermost piezoelectric sheet having no active portions actually deforms spontaneously. Accordingly, further reliable ink ejection can be performed according to the present embodiment. Moreover, unevenness in the thickness of the lowermost piezoelectric sheet 122 and/or the thickness of the adhesive sheet 41 does not affect ink ejection performance.

As described above, according to the present invention, the common electrodes and the drive electrodes corresponding to the pressure chambers are arranged in alternation with the piezoelectric sheets interposed therebetween. Active portions are formed between the drive electrodes and the common electrodes. The common electrodes and the cavity unit are connected to one another via a conductive material to have the same potential. Therefore, variation in electric potential among the electrodes can be prevented. Accordingly, the ink ejection performance is maintained uniform, and ink ejection from undesired nozzles is prevented, resulting in stable ink ejection.

Also, because the common electrodes and the cavity unit are connected to the ground to have the same potential of 0V, even when the drive electrodes confronting the pressure chambers via the lowermost piezoelectric sheet, the ink and the like are maintained at the constant voltage, whereby further stable ink ejection can be achieved.

Moreover, because a conductive adhesive or a metal member is used as the conductive member, and because the conductive member is provided to extend in the lamination direction of the piezoelectric actuator to connect the common electrodes, a compact-sized conductive member can be used. Because the piezoelectric sheets with the drive electrodes formed thereon and the piezoelectric sheets with the common electrode formed thereon are laminated one on the other and the resultant product is fixed to the cavity plate, the inkjet printer head is manufactured in a simple manner.

While some exemplary embodiments of this invention have been described in detail, those skilled in the art will recognize that there are many possible modifications and variations which may be made in these exemplary embodiments while yet retaining many of the novel features and advantages of the invention.

Figure 18:
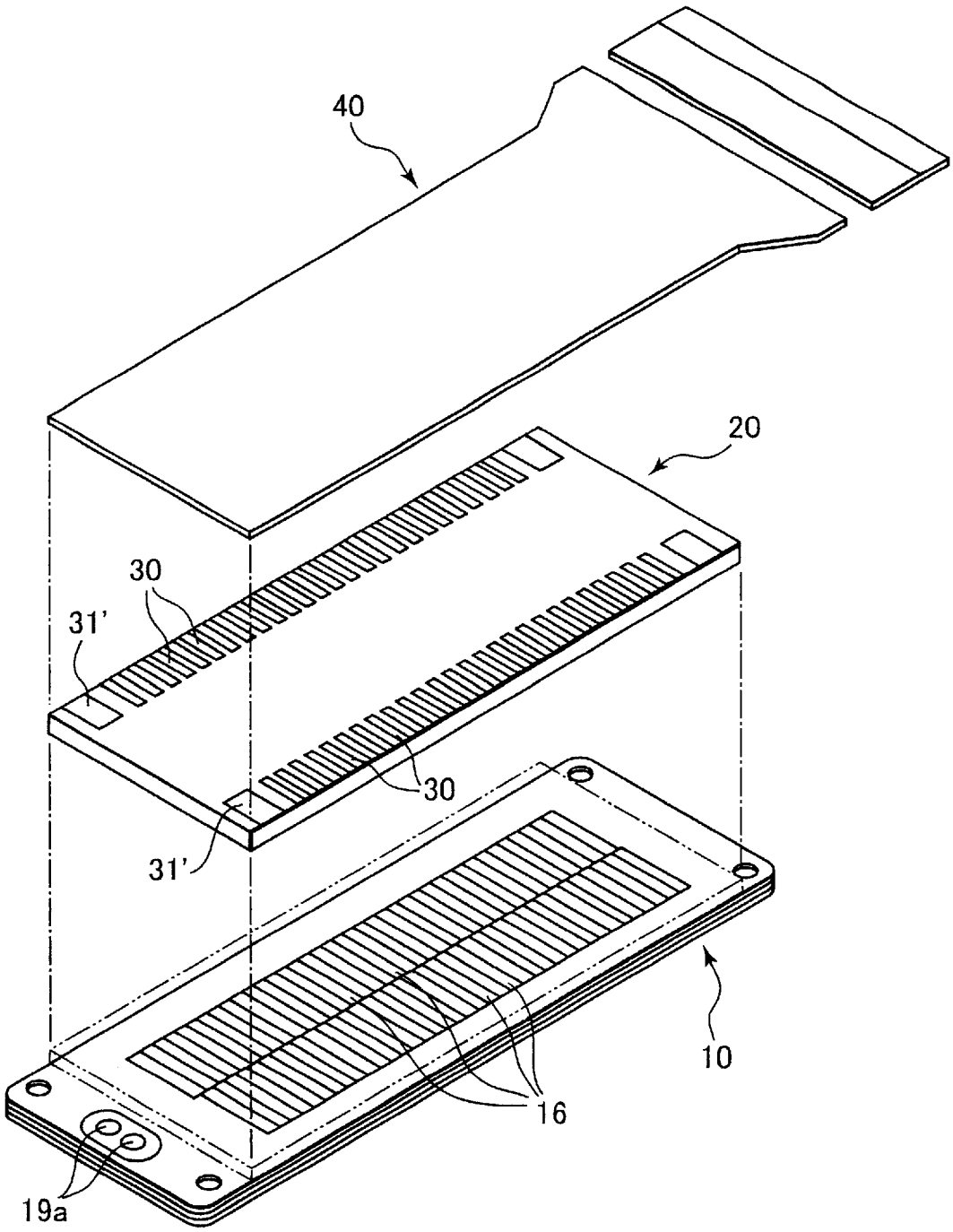
FIG. 18 is a cross-sectional view of one example of alternative inkjet printer heads according to the present invention.

For example, although the piezoelectric actuator 20 has the pair of surface electrodes 31 shown in FIG. 7 that extend along the entire width of the piezoelectric actuator 20 in the direction D2, the piezoelectric actuator 20 could have, as shown in FIG. 18, four surface electrodes 31' at the corners.

The common electrodes 25 and the cavity unit 10 are connected to the ground G via the electrically conductive member 60, 60A in the above-described embodiments. Although it is preferable to connect these components to the ground G, it is unnecessary to connect the common electrodes 25 and the cavity unit 10 to the ground G as long as the common electrodes 25 and the cavity unit 10 are connected and maintained at the same potential.

What is claimed is:

1. An inkjet head comprising:

a cavity unit formed of a conductive material with a plurality of nozzles and a plurality of pressure chambers in fluid communication with the corresponding nozzles, the plurality of pressure chambers being aligned in a predetermined direction;

an actuator including a plurality of sheet members laminated one on the other in a lamination direction, a plurality of driving electrodes corresponding to the pressure chambers, and a plurality of common electrodes, each sheet member having a width greater than a total width of the plurality of pressure chambers with respect to the predetermined direction, the plurality of driving electrodes and the plurality of common electrodes being arranged in alternation with respect to the lamination direction, each of the driving electrodes and the common electrodes being sandwiched between corresponding sheet members, wherein portions of the sheet members sandwiched between the driving electrodes and the common electrodes serve as active portions that selectively eject ink droplets from the corresponding pressure chambers through the nozzles; and a conductive member that electrically connects the common electrodes to the cavity unit for maintaining the common electrodes at the same potential as the cavity unit, wherein one of the sheet members has a first surface on which one of the common electrodes is formed and a second surface opposite to the first surface, the second surface being attached to the cavity plate.

2. The inkjet head according to claim 1, wherein the conductive member electrically connects the common electrodes and the cavity unit to the ground.

3. The inkjet head according to claim 1, wherein plural ones of the driving electrodes located closest to the cavity plate confront the cavity unit with plural ones of the sheet members interposed therebetween.

4. The inkjet head according to claim 3, wherein the sheet members are piezoelectric ceramic sheets and include first sheet members and second sheet members, each first sheet member being provided with some of the driving electrodes on one surface, each second sheet member being provided with one of the common electrodes on one surface.

5. The inkjet head according to claim 1, wherein the conductive member is placed on the cavity unit and on a side surface of the actuator, the side surface extending in the lamination direction.

6. The inkjet head according to claim 5, wherein the conductive member is selected one of a conductive adhesive and a metal.

7. An inkjet head comprising:

a cavity unit formed of an electrically conductive material with a plurality of nozzles and a plurality of pressure chambers in one-to-one correspondence with the nozzles, the pressure chambers being aligned in a predetermined direction;

an actuator attached to the cavity unit and including a plurality of sheets laminated one on the other and a plurality of drive electrodes positioned between corresponding sheets, the sheets having a width greater than a total width of the pressure chambers with respect to the predetermined direction, the drive electrodes corresponding to the pressure chambers; and a conductive member that grounds the cavity unit, wherein plural ones of the drive electrodes located closest to the cavity unit confront the cavity unit with more than one of the sheets interposed between the plural ones of the drive electrodes and the cavity unit.

8. The inkjet head according to claim 7, wherein the actuator further includes a plurality of common electrodes, and the drive electrodes and the common electrodes are positioned between the corresponding sheets in alternation with respect to a lamination direction in which the plurality of sheets are laminated, and the common electrodes are grounded.

9. The inkjet head according to claim 8, wherein the actuator has a side surface extending in the lamination direction on which the conductive member is provided, the conductive member being a selected one of a conductive adhesive and a metal, and the common electrodes are electrically connected to the conductive member.

* * * * *